US011460254B2

(12) United States Patent
Fujii et al.

(10) Patent No.: US 11,460,254 B2
(45) Date of Patent: Oct. 4, 2022

(54) HEAT PIPE AND METHOD FOR MANUFACTURING HEAT PIPE

(71) Applicant: Furukawa Electric Co., Ltd., Tokyo (JP)

(72) Inventors: Yoshito Fujii, Tokyo (JP); Tomoaki Toratani, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 16/798,142

(22) Filed: Feb. 21, 2020

(65) Prior Publication Data

US 2020/0208922 A1 Jul. 2, 2020

Related U.S. Application Data

(63) Continuation of application No. PCT/JP2018/030733, filed on Aug. 21, 2018.

(30) Foreign Application Priority Data

Aug. 23, 2017 (JP) ..... JP2017-160126

(51) Int. Cl.
*F28D 15/04* (2006.01)
*F28D 15/02* (2006.01)
*F28F 19/06* (2006.01)

(52) U.S. Cl.
CPC ..... *F28D 15/043* (2013.01); *F28D 15/0283* (2013.01); *F28F 19/06* (2013.01)

(58) Field of Classification Search
CPC ..... F28D 15/04; F28D 15/02; F28D 15/043; F28D 15/0283; F28D 15/00; F28D 15/046; F28F 16/06; F28F 19/06
See application file for complete search history.

(56) References Cited

U.S. PATENT DOCUMENTS 4,109,709 A * 8/1978 Honda ..... F28D 15/046 138/40
5,660,229 A * 8/1997 Lee ..... F24D 3/14 165/104.26
2004/0200603 A1 10/2004 Nagashima et al.
2006/0222423 A1 10/2006 Dejong et al.
(Continued)

FOREIGN PATENT DOCUMENTS

CN 1769828 A * 5/2006
CN 101442892 A 5/2009
(Continued)

OTHER PUBLICATIONS

English translation of International Preliminary Report on Patentability for Application No. PCT/JP2018/030733, dated Feb. 25, 2020.
English translation of Written Opinion for Application No. PCT/JP2018/030733, dated Nov. 6, 2018.
International Search Report and Written Opinion (EN translation of ISR only) for Application No. PCT/JP201 8/030733, dated Nov. 6, 2018.
(Continued)

*Primary Examiner* — Harry E Arant
(74) *Attorney, Agent, or Firm* — Dorsey & Whitney LLP

(57) ABSTRACT

A heat pipe includes a container including a container substrate and a working fluid enclosed in the container. The working fluid contains water. The heat pipe includes a first film containing tin and/or a tin alloy on at least an inner surface of the container substrate and a second film formed on at least a part of a surface of the first film and containing an oxide and/or hydroxide containing tin.

9 Claims, 4 Drawing Sheets

(56) References Cited

U.S. PATENT DOCUMENTS

| | | | | |
|---|---|---|---|---|
| 2009/0133855 | A1 | 5/2009 | Hsieh et al. | |
| 2009/0166014 | A1* | 7/2009 | Chang | F28D 15/02 165/133 |
| 2018/0066899 | A1* | 3/2018 | Hsieh | B23K 15/008 |

FOREIGN PATENT DOCUMENTS

| | | | | |
|---|---|---|---|---|
| CN | 101886889 | A | | 11/2010 |
| CN | 103868381 | A | | 6/2014 |
| JP | S57144890 | A | | 9/1982 |
| JP | S5896992 | A | | 6/1983 |
| JP | S61259087 | A | | 11/1986 |
| JP | H0996494 | A | * | 4/1997 |
| JP | 09-096494 | A | | 8/1997 |
| JP | 2001348681 | A | * | 12/2001 |
| JP | 2001348681 | A | | 12/2001 |
| JP | 2002168577 | A | | 6/2002 |
| JP | 2003214780 | A | | 7/2003 |
| JP | 2004325063 | A | | 11/2004 |
| JP | 2006284167 | A | | 10/2006 |
| JP | 2007263535 | A | | 10/2007 |
| JP | 2016035357 | A | | 3/2016 |
| JP | 2017106695 | A | | 6/2017 |

OTHER PUBLICATIONS

[English Translation] 2nd Office Action dated Jun. 7, 2021 for CN Application No. 201880054680.1.

English translation of Office Action for CN Application No. 201880054680.1, dated Oct. 27, 2020.

[English Translation] 4th Chinese Office Action dated Feb. 7, 2022 for Chinese Patent Application No. 201880054680.1; pp. all.

[English Translation] Huang, Wenying , "Basics of heat pipe and heat pipe heat exchanger design", ISBN 7-118-02067-4, Published and Distributed by China Railway Press Edition: 1st printing of 1st Edition in Nov. 1995, Nov. 1995; pp. all.

[English Translation] Third Office Action dated Nov. 2, 2021 for Chinese Application No. 201880054680.1.

[English Translation] Rejection Decision dated May 5, 2022 for Chinese Patent Application No. 201880054680.1; pp. all.

[English Translation] Notice of Reasons for Refusal dated May 30, 2022 for Japanese Patent Application No. 2018-567972; pp all.

[English Translation] Office Action dated Jun. 2, 2022 for Taiwanese Patent Application No. 107129222; pp. all.

[English Translation] Notice of Reasons for Refusal dated Aug. 16, 2022 for Japanese Patent Application No. 2018-567972; pp. all.

* cited by examiner

HEAT PIPE AND METHOD FOR MANUFACTURING HEAT PIPE

CROSS REFERENCE TO RELATED APPLICATIONS

The present application is a continuation application of International Patent Application No. PCT/JP2018/030733 filed on Aug. 21, 2018, which claims the benefit of Japanese Patent Application No. 2017-160126, filed on Aug. 23, 2017. The contents of these applications are incorporated herein by reference in their entirety.

BACKGROUND

Technical Field

The present disclosure relates to a heat pipe capable of exhibiting excellent heat transport characteristics while maintaining a degree of vacuum in a container, and a method for manufacturing the heat pipe.

Background

Electronic components such as semiconductor elements mounted on electrical and electronic devices have increased amounts of heat generation due to higher performance and an increase in current and the like, and thus cooling of the components has become more important. A heat pipe may be used as a method for cooling electronic components.

In recent years, for example, mobile devices, and electrical and electronic devices mounted on vehicles have been further required to be reduced in weight. Accordingly, reduction in the weight of a heat pipe is also required. From the viewpoint of the reduction in the weight of the heat pipe, the use of aluminum, an aluminum alloy, magnesium, and a magnesium alloy and the like has been considered as the material of a container. As a working fluid enclosed in the container, water may be used from the viewpoint of excellent heat transport characteristics. However, aluminum, an aluminum alloy, magnesium, and a magnesium alloy are apt to chemically react with water, and if water is used as a working fluid in a container made of aluminum, an aluminum alloy, magnesium, or a magnesium alloy and the like, a hydrogen gas is generated by the chemical reaction between the container and the water, to cause a decrease in the degree of vacuum in the heat pipe. As a result, the heat transport characteristics of the heat pipe may be deteriorated.

Furthermore, the chemical reaction between aluminum, an aluminum alloy, magnesium, or a magnesium alloy as the material of a container and water as a working fluid causes the container to be corroded.

Therefore, when aluminum or the like is used as the container material and water is used as the working fluid, a covering layer having an anticorrosive function is conventionally formed on the inner surface of the container.

As a heat pipe including the covering layer having the anticorrosive function for the container, for example, the following heat pipe is proposed. In the heat pipe, a silicate ($SiO_2$) film, an alumite ($Al_2O_3$) film, a boehmite film or the like is formed as a protective film not permitting moisture to pass through the protective film on the inner wall of a container made of aluminum, and water is enclosed as a working fluid (Japanese Patent Application Laid-Open No. 2004-325063). In Japanese Patent Application Laid-Open No. 2004-325063, the protective film such as a silicate ($SiO_2$) film, an alumite ($Al_2O_3$) film, or a boehmite film is hard. Since this may cause defects such as cracks to occur, negative ions are added to the water to serve to restore a defect portion of the film.

However, in Japanese Patent Application Laid-Open No. 2004-325063, the protective film is hard. This causes defects such as cracks to still occur in the protective film if bending for sealing the container or processing such as bending or flattening for shape change is performed, or the amount of heat generation of an object to be cooled increases to cause an increase in thermal loads to the heat pipe. If the defects such as cracks occur in the protective film, water intruding from the defects chemically reacts with the material of the container to generate a gas (for example, a hydrogen gas). This is apt to cause heat transport characteristics to be deteriorated. The material of the container and the water chemically react with each other. This is apt to cause the container to be corroded. Furthermore, the protective film of Japanese Patent Application Laid-Open No. 2004-325063 is difficult to impart high sealing properties to the container when the container is sealed by welding. In order to impart corrosion resistance to water, a heat pipe covered with lead is proposed (Japanese Patent Application Laid-Open No. 61-259087). However, a corrosion-resistant coat made of lead is not preferred because of environmental burdens. A heat pipe using a container coated with nickel (Japanese Patent Application Laid-Open No. 2006-284167) and a heat pipe using a cladding material such as a copper member or an aluminum member for a container (Japanese Patent Application Laid-Open No. 2002-168577) are proposed as a heat pipe provided with another corrosion-resistant coat. However, if bending for sealing the container or processing such as bending or flattening for shape change is performed, after all, defects such as cracks occur in the nickel coating of Japanese Patent Application Laid-Open No. 2006-284167. The cladding material of Japanese Patent Application Laid-Open No. 2002-168577 is difficult to manufacture a thin material required to achieve size and weight reduction in recent years, and has room for improvement from the viewpoint of reduction in weight. An attempt to forcedly make the material thinner causes imperfect covering of the material of the container. Accordingly, the material of the container and the water chemically react with each other. This may be apt to cause the generation of a gas and the corrosion of the container.

SUMMARY

The present disclosure is related to providing a heat pipe capable of preventing the corrosion of a container and the generation of a hydrogen gas caused by a working fluid containing water even if the container is subjected to plastic deformation such as bending or an object to be cooled having a large amount of heat generation is thermally connected, and a method for manufacturing the heat pipe.

An aspect of the present disclosure is a heat pipe including: a container including a container substrate; and a working fluid enclosed in the container, wherein: the working fluid contains water; and the heat pipe includes a first film containing tin and/or a tin alloy on at least an inner surface of the container substrate and a second film formed on at least a part of a surface of the first film and containing an oxide and/or hydroxide containing tin.

An aspect of the present disclosure is the heat pipe, wherein the tin alloy contains at least one metal selected from the group consisting of copper, nickel, silver, lead, and bismuth.

An aspect of the present disclosure is the heat pipe, wherein an average thickness of the second film is 5 nm or more and 200 nm or less.

An aspect of the present disclosure is the heat pipe, wherein the container substrate is made of at least one metal selected from the group consisting of aluminum, an aluminum alloy, magnesium, a magnesium alloy, titanium, a titanium alloy, and stainless steel.

An aspect of the present disclosure is the heat pipe, wherein an average thickness of the first film is 1 μm or more and 30 μm or less.

An aspect of the present disclosure is the heat pipe including one or two or more intermediate layers provided between a surface of the container substrate and the first film and made of at least one metal selected from the group consisting of nickel, zinc, cobalt, chromium, and copper, and/or an alloy containing at least one metal selected from the group consisting of nickel, zinc, cobalt, chromium, and copper.

An aspect of the present disclosure is the heat pipe, wherein an average thickness of the intermediate layers is 0.001 μm or more and 2 μm or less.

An aspect of the present disclosure is the heat pipe, wherein a wick structure is accommodated in the container.

An aspect of the present disclosure is the heat pipe, wherein the wick structure is made of a glass material.

An aspect of the present disclosure is the heat pipe, wherein the glass material is at least one selected from the group consisting of glass fiber, glass wool, glass cloth, and glass nonwoven fabric.

An aspect of the present disclosure is a method for manufacturing a heat pipe including a container including a container substrate, and a working fluid containing water enclosed in the container, the method including: a step of preparing a container including a first film containing tin and/or a tin alloy on at least an inner surface of the container substrate and a second film formed on at least a part of a surface of the first film and containing an oxide and/or hydroxide containing tin; an injecting step of injecting a working fluid into an inside of the container; a deaerating step of deaerating the inside of the container including the injected working fluid; and a sealing step of sealing an end portion of the deaerated container.

An aspect of the present disclosure is the method for manufacturing a heat pipe, further including a heat treating step of melting the first film.

According to the aspect of the present disclosure, the first film containing tin and/or a tin alloy is formed on at least the inner surface of the container substrate, and the second film containing an oxide and/or hydroxide containing tin is formed on the surface of the first film, whereby the corrosion of the container and the generation of a hydrogen gas caused by the working fluid containing water can be prevented even if the container is subjected to plastic deformation such as bending or an object to be cooled having a large amount of heat generation is thermally connected. This can accordingly prevent deterioration in the heat transport characteristics of the heat pipe.

According to the aspect of the present disclosure, the average thickness of the second film is 5 nm or more and 200 nm or less, whereby the corrosion of the container and the generation of the hydrogen gas caused by the working fluid containing water can be more certainly prevented even if the object to be cooled having a large amount of heat generation is thermally connected, and the container is subjected to plastic deformation such as bending, to more certainly prevent deterioration in the heat transport characteristics of the heat pipe.

According to the aspect of the present disclosure, the average thickness of the first film is 1 μm or more and 30 μm or less. This can more certainly contribute to the prevention of the corrosion of the container and the generation of the hydrogen gas caused by the working fluid containing water while preventing an increase in the weight of the container.

According to the aspect of the present disclosure, the wick structure is made of the glass material, whereby the chemical reaction between the working fluid containing water and the wick structure can be prevented. This can more certainly prevent the generation of the hydrogen gas inside the container.

DETAILED DESCRIPTION

A heat pipe according to an embodiment of the present disclosure will be described below with reference to the drawings.

Figure 1:
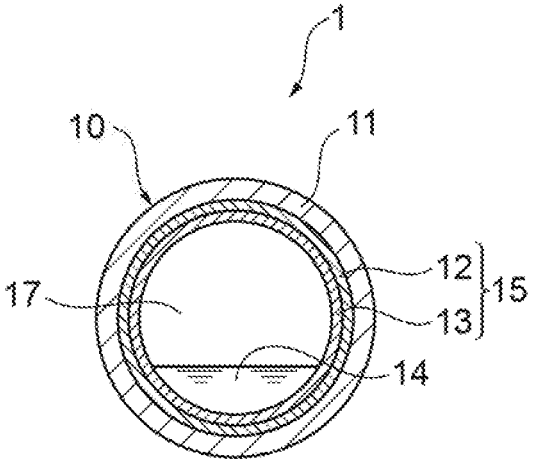
FIG. 1 is a front cross sectional view of a heat pipe according to a first embodiment of the present disclosure.
Figure 2:
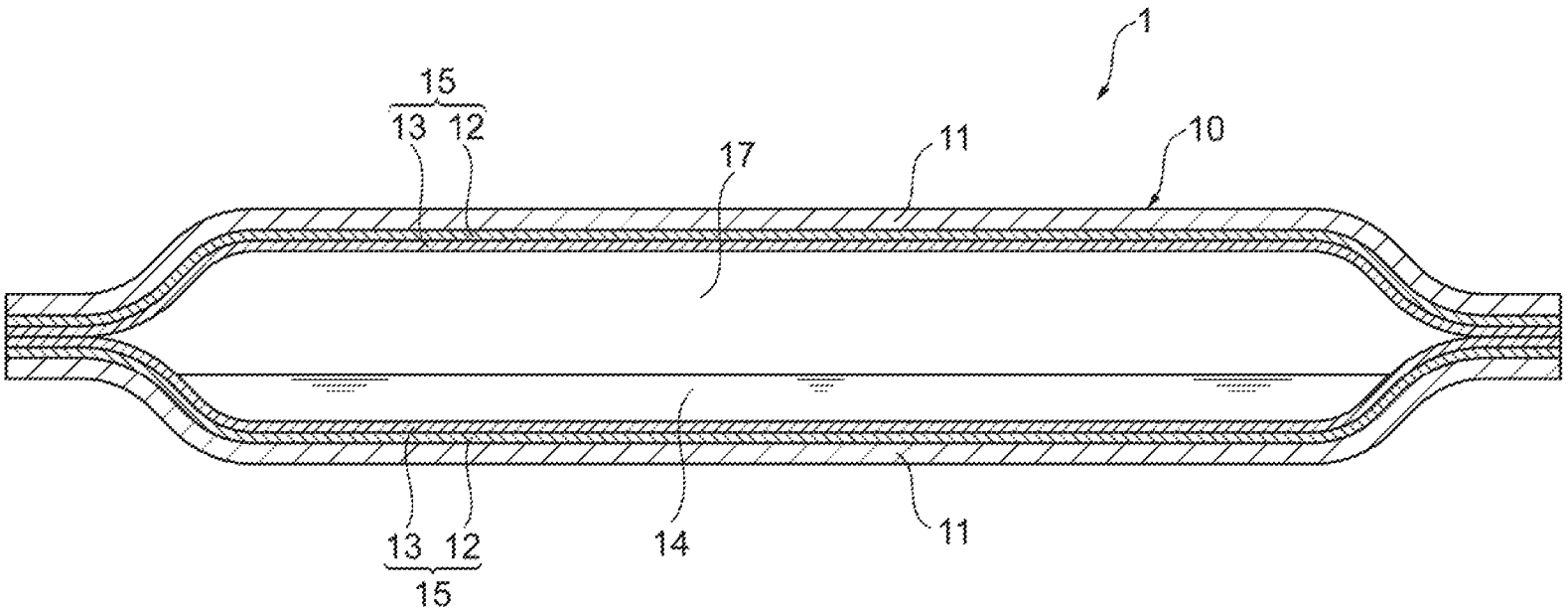
FIG. 2 is a side cross sectional view of the heat pipe according to the first embodiment of the present disclosure.

As shown in FIGS. 1 and 2, a heat pipe 1 according to a first embodiment of the present disclosure includes a container 10 including a container substrate 11 and a working fluid 14 enclosed in the container 10. A hollow portion 17 is provided in the container 10, and the working fluid 14 is enclosed in the hollow portion 17.

A first film 12 is provided on at least an inner surface of the container substrate 11. A second film 13 is further provided on a surface of the first film 12. A multi-layer structure 15 including the first film 12 and the second film 13 is therefore formed on at least the inner surface of the container substrate 11. In the multi-layer structure 15, the surface of the first film 12 is covered with the second film 13.

In the heat pipe 1 according to the first embodiment, the container substrate 11 is a pipe material, and the longitudinal (axis) direction of the pipe material is a heat transport direction. The shape of the container substrate 11 in a radial direction (i.e., a direction orthogonal to the longitudinal direction) is not particularly limited and can be appropriately selected depending on the status of use. Examples of the shape include a substantially circular shape, an ellipse shape, a flat shape, a rectangle shape, and a rounded rectangle shape. In FIG. 1, the shape of the container substrate 11 in the radial direction is a circular shape. The shape of the container substrate 11 in the longitudinal direction is not particularly limited and can be appropriately selected depending on the status of use. Examples of the shape include a shape including a bent portion such as an L shape, a U shape, or a shape including a step portion, and a linear shape. In FIG. 2, the shape of the container substrate 11 in the longitudinal direction is the linear shape.

The material of the container substrate 11 is not particularly limited and can be appropriately selected depending on the status of use. For example, from the viewpoints of heat conductivity and of preventing an increase in weight, aluminum, an aluminum alloy, magnesium, a magnesium alloy, titanium, a titanium alloy, and stainless steel are preferred. From the viewpoint of further reduction in weight, aluminum, an aluminum alloy, magnesium, and a magnesium alloy are particularly preferred.

In the heat pipe 1, from the viewpoints of obtaining excellent heat transport characteristics, of preventing environmental burdens, and of providing manageability, the working fluid 14 contains water. The working fluid 14 may be blended with an additive agent such as a pH adjuster or an antifreeze solution as necessary.

As shown in FIGS. 1 and 2, the inner surface of the container substrate 11 is covered with the first film 12. In the heat pipe 1, the inner surface of the container substrate 11 contacts the first film 12 as one aspect. The first film 12 serves as a covering layer containing tin and/or a tin alloy such as a covering layer made of tin and/or a tin alloy as a constituent. The first film 12 as the covering layer containing tin and/or a tin alloy provides covering for imparting anticorrosive properties to the inner surface of the container 10. The first film 12 as the covering layer containing tin and/or a tin alloy is softer than a silicate ($SiO_2$) film, an alumite ($Al_2O_3$) film, a boehmite film and the like. Therefore, even if the container 10 is subjected to plastic deformation such as bending or flattening, defects such as cracks can be prevented from occurring in the first film 12. This can prevent the chemical reaction between the container substrate 11 and the water contained in the working fluid 14 from generating a hydrogen gas. The first film 12 is not a covering layer made of lead, and can prevent environmental burdens.

From the above description, the first film 12 is formed on the inner surface of the container substrate 11. This contributes to the corrosion prevention of the container 10, and can prevent the generation of the hydrogen gas even if the container 10 is subjected to processing such as bending or flattening, to maintain excellent heat transport characteristics.

Furthermore, the first film 12 containing tin and/or a tin alloy is a relatively soft covering layer, whereby the first film 12 can impart excellent sealing properties to the container 10. This provides improved airtightness of the hollow portion 17.

In the heat pipe 1, at least the whole inner surface of the container substrate 11 may be covered with the first film 12. Furthermore, the whole outer surface of the container substrate 11 may be covered with a material of the same type as the first covering, i.e., a covering layer containing tin and/or a tin alloy.

The first film 12 may be constituted by one layer or a plurality of layers. In the heat pipe 1, the first film 12 has a one-layer structure.

The average thickness of the first film 12 is not particularly limited and can be appropriately selected depending on the status of use. For example, from the viewpoint of certainly covering the inner surface of the container substrate 11 to impart anticorrosive properties, thereby preventing the generation of the hydrogen gas, the lower limit of the average thickness is preferably 1 μm, and particularly preferably 5 μm. Meanwhile, from the viewpoint of reduction in weight, the upper limit of the average thickness of the first film 12 is preferably 30 μm, and particularly preferably 15 μm. The first film 12 made of the tin alloy can provide improvement in anticorrosive properties and adjustment of a melting point. The alloying causes change in the melting point of the first film 12, whereby the composition of the tin alloy may be adjusted in view of conditions in a heat treatment for melting the first film 12 and when the heat pipe of the present disclosure is mounted by soldering and the like. When the tin alloy is used, for example, the tin alloy preferably contains at least one metal selected from the group consisting of copper (Cu), nickel (Ni), silver (Ag), lead (Pb), and bismuth (Bi) as components of the tin alloy. Examples of the tin alloy include a SnCu alloy (for example, a Sn-3% by mass Cu alloy, a $Cu_6Sn_5$ compound), a SnNi alloy (for example, a $Ni_3Sn_4$ compound), a SnAg alloy (for example, a Sn-3.5% by mass Ag alloy), a SnPb alloy (for example, a Sn-10% by mass Pb alloy, a Sn-38% by mass Pb alloy), a SnBi alloy (for example, a Sn-0.5% by mass Bi alloy, a Sn-3% by mass Bi alloy, and a Sn-58% by mass Bi alloy). Among these, from the viewpoint of preventing environmental burdens, a lead-free tin alloy is more preferred, and from the viewpoint of improvement in anticorrosive properties, a tin alloy containing bismuth is particularly preferred.

Meanwhile, only the first film 12 as the covering layer containing tin and/or a tin alloy does not have a sufficient corrosion prevention function for the container 10. Then, in the heat pipe 1, as shown in FIGS. 1 and 2, the second film 13 is laminated on the first film 12. The second film 13 is exposed to the hollow portion 17 as an internal space of the container 10. The second film 13 serves as a covering layer containing an oxide and/or hydroxide containing tin as a constituent. In the heat pipe 1, the first film 12 is provided between the inner surface of the container substrate 11 and the second film 13. Therefore, a region in the first film 12 is not exposed to the hollow portion 17 of the container 10 as one aspect. In the region, the second film 13 is provided.

The second film 13 as the covering layer containing an oxide and/or hydroxide containing tin provides covering for further improving the anticorrosive properties of the inner surface of the container 10. The second film 13 is therefore formed on the first film 12, whereby the corrosion of the container 10 caused by the working fluid 14 containing water can be prevented to prevent the generation of the hydrogen gas even if an object to be cooled having a large amount of heat generation is thermally connected to the container 10 to increase thermal loads to the heat pipe 1. As a result, deterioration in the heat transport characteristics of the heat pipe can be prevented over a long period of time. The second film 13 is not a covering layer made of lead, whereby environmental burdens can be prevented.

The second film 13 may cover the whole surface of the first film 12. The second film 13 may cover a partial area of the surface of the first film 12, for example, only an area corresponding to a central portion of the container substrate 11 in the longitudinal direction, only an area corresponding to both end portions or one end portion of the container substrate 11 in the longitudinal direction, or only an area corresponding to a part of a peripheral surface of the container substrate 11 in the radial direction. When the second film 13 covers the partial area of the surface of the first film 12, in an area not covered with the second film 13 in the surface of the first film 12, the first film 12 is exposed to the hollow portion 17 of the container 10 as one aspect. In the heat pipe 1, the whole surface of the first film 12 is covered with the second film 13. When the whole outer surface of the container substrate 11 is also covered with a material of the same type as the first covering, the covering of the outer surface of the container substrate 11 may be further covered with a material of the same type as the second covering.

The second film 13 may be constituted by one layer or a plurality of layers. In the heat pipe 1, the second film 13 has a one-layer structure.

The average thickness of the second film 13 is not particularly limited and can be appropriately selected depending on the status of use. For example, from the viewpoint of further improving the anticorrosive properties of the container 10 certainly, the lower limit of the average thickness is preferably 5 nm, and particularly preferably 10 nm. From the viewpoints of the sealing properties of the container 10 and of preventing the generation of cracks during plastic deformation such as bending or flattening, the upper limit of the average thickness of the second film 13 is preferably 200 nm, and particularly preferably 100 nm.

In the heat pipe 1, a wick structure (not shown) having a capillary force may be accommodated in the container 10. The wick structure is accommodated in the container 10, whereby the working fluid 14 changing phases from a gas phase to a liquid phase in a heat dissipating portion of the heat pipe 1 can be smoothly refluxed to a heat receiving portion of the heat pipe 1.

Any wick structure can be used as long as it is generally used. From the viewpoint that the wick structure contacts the working fluid 14 containing water in the copresence of the container substrate 11 and the wick structure to prevent the chemical reaction from being promoted, the wick structure is preferably made of a glass material. From the viewpoint of obtaining a sufficient capillary force, the glass material is particularly preferably glass fiber, glass wool, glass cloth, and glass nonwoven fabric. These may be used singly or in combination of two or more.

The position of the wick structure in the container 10 is not particularly limited and can be appropriately selected depending on the status of use. Examples of the position include the whole longitudinal direction of the container 10, and a region corresponding to the heat receiving portion in the longitudinal direction of the container 10.

Thereafter, the heat transport mechanism of the heat pipe 1 according to the first embodiment of the present disclosure will be described with reference to FIGS. 1 and 2.

First, in the container 10, a heat generating member (not shown) is thermally connected to a predetermined region (for example, an end portion or a central portion). When the heat pipe 1 receives heat from the heat generating member in the heat receiving portion, the working fluid 14 undergoes phase change from a liquid phase to a gas phase in the heat receiving portion. The hollow portion 17 as the internal space of the container 10 functions as a steam flow path. In the steam flow path, the gas phase working fluid 14 circulates. The gas phase working fluid 14 flows through the steam flow path from the heat receiving portion to the heat dissipating portion in the longitudinal direction of the container 10, thereby transporting the heat from the heat generating member to the heat dissipating portion from the heat receiving portion. The heat from the heat generating member transported from the heat receiving portion to the heat dissipating portion undergoes phase change from a gas phase working fluid 14 to a liquid phase working fluid in the heat dissipating portion provided with a heat exchange unit as necessary, thus being discharged as latent heat. The latent heat discharged in the heat dissipating portion is discharged from the heat dissipating portion to the external environment of the heat pipe 1. For example, the working fluid 14 undergoing phase change from a gas phase to a liquid phase in the heat dissipating portion is taken in by the wick structure (not shown) accommodated in the container 10, and is refluxed from the heat dissipating portion to the heat receiving portion by the capillary force of the wick structure.

Thereafter, a heat pipe according to a second embodiment of the present disclosure will be described below with reference to the drawings. The same reference characters are used for the same components as those of the heat pipe of the first embodiment.

Figure 3:
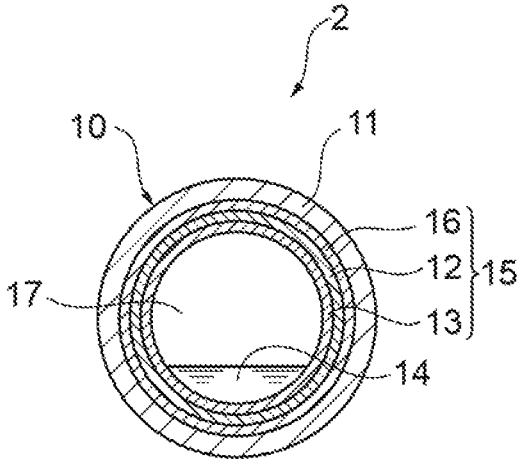
FIG. 3 is a front cross sectional view of a heat pipe according to a second embodiment of the present disclosure.
Figure 4:
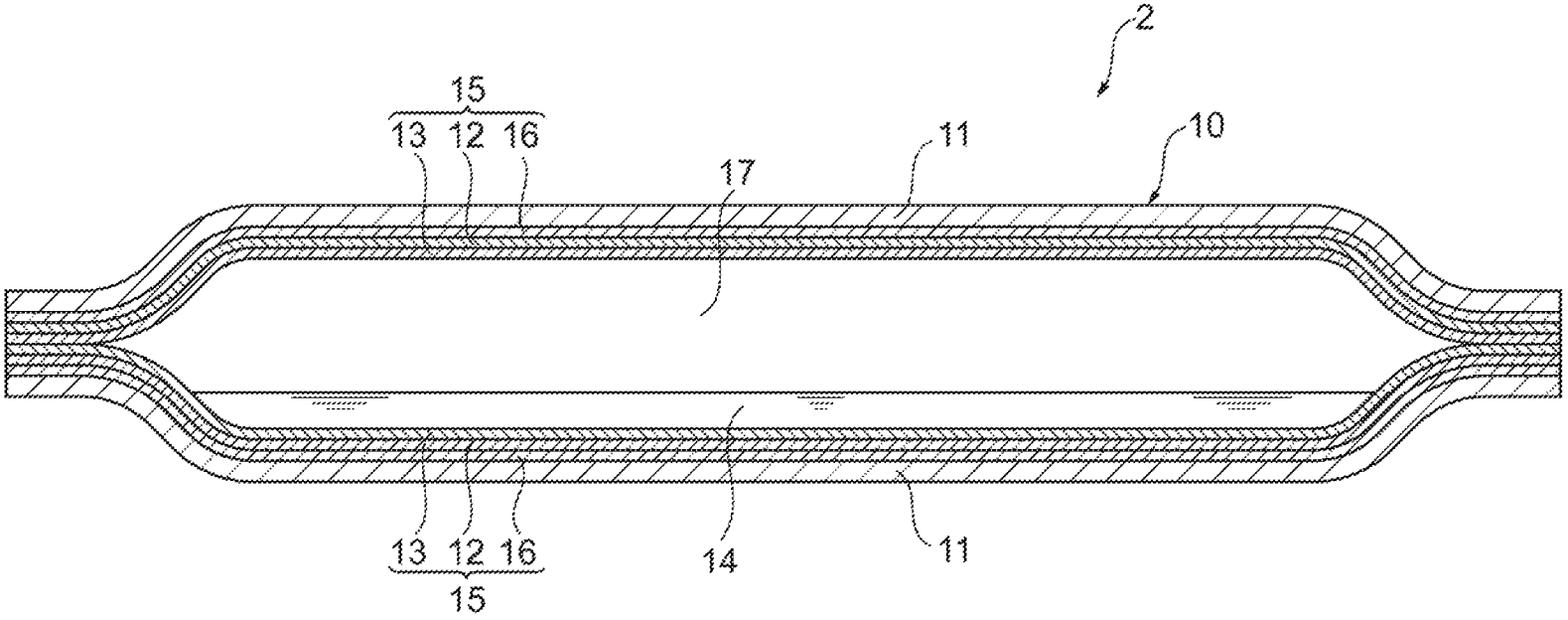
FIG. 4 is a side cross sectional view of the heat pipe according to the second embodiment of the present disclosure.

In the heat pipe 1 according to the first embodiment, at least the inner surface of the container substrate 11 contacts the first film 12, but in place of this constitution, as shown in FIGS. 3 and 4, in a heat pipe 2 according to the second embodiment, an intermediate layer 16 is further provided between the surface of a container substrate 11 and a first film 12. In an area in the heat pipe 2, therefore, the surface of the container substrate 11 contacts the intermediate layer 16 without contacting the first film 12, as one aspect. In the area, the intermediate layer 16 is provided.

In the heat pipe 2, a multi-layer structure 15 is formed on at least the inner surface of the container substrate 11. In the multi-layer structure 15, the intermediate layer 16, the first film 12, and the second film 13 are laminated. The intermediate layer 16 is provided between the inner surface of the container substrate 11 and the first film 12, whereby the adhesiveness of the first film 12 to the surface of the container substrate 11 can be improved while the anticorrosive properties of the inner surface of the container 10 are further improved.

Examples of the component of the intermediate layer 16 include metals such as nickel, zinc, cobalt, chromium, and copper, and alloys containing metals such as nickel, zinc, cobalt, chromium, and copper. These components may be used singly or in combination of two or more.

The intermediate layer 16 may cover the whole inner surface of the container substrate 11. The intermediate layer 16 may cover a partial area of the inner surface of the container substrate 11, for example, only a central portion of the container substrate 11 in the longitudinal direction, only both end portions or one end portion of the container substrate 11 in the longitudinal direction, or only a part of a peripheral surface of the container substrate 11 in the radial direction. The intermediate layer 16 may cover a part or whole of the outer surface of the container substrate 11. In the heat pipe 2, the whole inner surface of the container substrate 11 is covered with the intermediate layer 16.

The intermediate layer 16 may be constituted by one layer or a plurality of layers. In the heat pipe 2, the intermediate layer 16 has a one-layer structure.

The average thickness of the intermediate layer 16 is not particularly limited and can be appropriately selected depending on the status of use. For example, from the viewpoint of certainly improving the adhesiveness of the first film 12 while certainly improving the anticorrosive properties of the container 10, the lower limit of the average thickness is preferably 0.001 more preferably 0.01 μm, and particularly preferably 1 μm. Meanwhile, from the viewpoint of preventing the generation of cracks during plastic deformation such as bending or flattening of the container 10, the upper limit of the average thickness of the intermediate layer 16 is preferably 5 μm, and particularly preferably 2 μm.

Thereafter, an example of a method for manufacturing a heat pipe of the present disclosure will be described. For example, the method for manufacturing the heat pipe of the present disclosure includes a step of preparing a container 10 including a first film 12 formed on at least the inner surface of a container substrate 11 and a second film 13 formed on the surface of the first film 12, an injecting step of injecting a working fluid 14 into an inside of the container 10, a deaerating step of deaerating the inside of the container 10 including the injected working fluid 14, and a sealing step of sealing an end portion of the deaerated container 10.

As described above, in the method for manufacturing the heat pipe of the present disclosure, first, the container 10 is prepared. The container 10 includes the first film 12 formed on at least the inner surface of the container substrate 11 and the second film 13 formed on the surface of the first film 12. In a method for producing the container 10, for example, when the intermediate layer 16 is provided on the container substrate 11, the intermediate layer 16 is first formed on at least the inner surface of the container substrate 11, and the first film 12 is formed on the surface of the intermediate layer 16 after the intermediate layer 16 is formed. The second film 13 is then formed on the surface of the first film 12. Thereafter, the container 10 can be produced by sealing a portion excluding a portion required to remove the gas in the container 10 in a peripheral portion of the container substrate 11 during the deaerating step. Meanwhile, when the intermediate layer 16 is not provided on the container substrate 11, the first film 12 is first formed on at least the inner surface of the container substrate 11, and the second film 13 is then formed on the surface of the first film 12. The portion excluding the portion required to remove the gas in the container 10 in the peripheral portion of the container substrate 11 during the deaerating step is sealed, whereby the container 10 can be produced.

The method for sealing the container substrate 11 is not particularly limited, and known methods can be used. Examples of the methods include TIG welding, resistance welding, laser welding, pressure welding, and soldering.

Examples of the method for forming the intermediate layer 16 include, but are not particularly limited to, electrolysis plating, electroless plating, and a chemical conversion treatment. The intermediate layer 16 may be formed after the surface of the container substrate 11 is subjected to a washing treatment such as solvent degreasing, electric field degreasing, pickling, or etching treatment as necessary.

The method for forming the first film 12 is not particularly limited, and the first film 12 can be formed by, for example, electrolysis plating, electroless plating, hot dipping, and vapor deposition and the like. The first film 12 may be formed after the surface of the container substrate 11 (the surface of the intermediate layer 16 when the intermediate layer 16 is formed) is subjected to a washing treatment such as solvent degreasing, electric field degreasing, pickling, or etching treatment as necessary. A film containing a metal-containing component constituting the component of the first film 12 may be formed on the intermediate layer 16 formed as described above by electrolysis plating, electroless plating, hot dipping, and vapor deposition and the like, followed by causing the film containing the metal-containing component to react with the intermediate layer 16 according to a heat treatment and the like for alloying, thereby forming the first film 12. A plurality of films containing the metal-containing component constituting the component of the first film 12 may be formed by electrolysis plating, electroless plating, hot dipping, and vapor deposition and the like, followed by heat-treating the plurality of films containing the metal-containing component for alloying, thereby forming the first film 12.

The method for forming the second film 13 is not particularly limited, and examples of the method include oxidation treatments such as a heat treatment for the first film 12 in an oxygen gas-containing gas phase atmosphere, a heat treatment for the first film 12 immersed in a water-containing solution, an anode oxidation treatment, a treatment for exposing the first film 12 to vapor produced from a water-containing solution, and a heat treatment for the first film 12 in vapor produced from a water-containing solution.

A heat treating step of heating the first film 12 for melting may be added before the formation of the second film 13 or during the formation of the second film 13, after the formation of the first film 12. Defects such as holes contained in the first film are eliminated according to the heat treating step, whereby the reaction between the container substrate 11 and the working fluid 14 can be more certainly prevented. Examples of the method for the heat treatment for heating the first film 12 for melting include, but are not particularly limited to, continuous type heat treatments such as a batch type heat treatment, an electrical heating type heat treatment, a dielectric heating type heat treatment, and a travelling heat treatment.

Thereafter, the working fluid 14 is injected into the inside of the container 10 prepared as described above. The method for injecting the working fluid 14 is not particularly limited, and known methods can be used. The working fluid 14 may be heated as necessary to discharge a dissolved gas in the working fluid 14 before being injected into the inside of the container 10.

Thereafter, the inside of the container 10 including the injected working fluid 14 is deaerated via a region not sealed in the peripheral portion of the container substrate 11. This deaerating treatment reduces the pressure of a hollow portion 17 of the container 10. The deaerating method is not particularly limited, and known methods can be used. Examples of the deaerating method include vacuuming and heating deaeration.

Thereafter, the heat pipe of the present disclosure can be manufactured by sealing the region not sealed for the deaerating treatment in the peripheral portion of the container substrate 11. A method for sealing the region not sealed for the deaerating treatment is not particularly limited as described above, and known methods can be used. Examples of the methods include TIG welding, resistance welding, laser welding, pressure welding, and soldering.

A wick structure may be accommodated in the container 10 before the deaerating step as necessary. After the wick structure is subjected to a washing treatment such as solvent degreasing or pickling as necessary, the wick structure may be accommodated in the container 10.

Thereafter, another embodiment of a heat pipe of the present disclosure will be described. The container substrate 11 is made of the pipe material in each of the above-mentioned embodiments. In place of this constitution, the container substrate 11 may have a plane type constitution obtained by combining two opposing plate-shaped bodies.

In the example of the method for manufacturing the heat pipe of the present disclosure as described above, the portion excluding the portion required to remove the gas in the container 10 in the peripheral portion of the container substrate 11 in the deaerating step is sealed after the intermediate layer 16, the first film 12, and the second film 13 are formed. In place of this constitution, the portion excluding the portion required to remove the gas in the container 10 in the deaerating step may be sealed, followed by forming the intermediate layer 16, the first film 12, and the second film 13. The second film 13 may be formed in the heat treating step of heating the first film 12 for melting, the step of subjecting the container 10 to a deaerating treatment according to heating deaeration and the like, and the step of sealing the container 10, and the like.

EXAMPLES

Thereafter, Examples of the present disclosure will be described, but the present disclosure is not limited to these examples without departing from the spirit of the present disclosure.

A heat pipe having a diameter of 8 mm and a length of 220 mm, including a container substrate having a thickness of 0.3 mm, and having a linear shape was used as a heat pipe used in each of Examples 1 to 23 and Comparative Examples 1 and 2. The container substrate to be used was made of aluminum. Water was enclosed as a working fluid.

The first film (Sn or a Sn alloy), second film (SnO), and intermediate layer of the heat pipe used in each of Examples 1 to 23 and Comparative Examples 1 and 2 are shown in detail in the following Table 1. The average thickness of the second film was measured by the depth analysis of X-ray photoelectron spectroscopy (XPS), and the average thickness of the first film and the average thickness of the intermediate layer were measured by fluorescent X-ray analysis.

Evaluation (1) Anti-Corrosive Property (Durability)

The heat pipe was heat-treated in an oven at 90° C. for 1000 hours. Then, the length of the heat pipe was directed in a vertical direction, and a portion between a lower end of the heat pipe and a position separated by 80 mm from the lower end was immersed in hot water at 50° C. A thermo couple was connected to a position separated by 40 mm from the lower end and a position separated by 15 mm from an upper end. A difference (ΔT) between the temperatures of the lower and upper ends was measured. The measurement results were evaluated by the following four steps.

Very Good: ΔT is less than ΔT of Comparative Example 1 by 1.5° C. or higher.

Good: ΔT is less than ΔT of Comparative Example 1 by 1.0° C. or higher and lower than 1.5° C.

Average: ΔT is less than ΔT of Comparative Example 1 by 0.5° C. or higher and lower than 1.0° C.

Poor: ΔT is less than ΔT of Comparative Example 1 by lower than 0.5° C., or more than ΔT of Comparative Example 1.

(2) Processability

The heat pipe was bent at angle of 30 degrees. The appearance of the second film in the bent portion was visually observed, and evaluated by the following three steps.

Good: Defects such as cracks are not observed.

Average: Defects such as cracks are slightly observed.

Poor: Defects such as cracks are remarkably observed.

(3) Sealing Properties

A sealed portion was formed by resistance welding. A leak test of a helium gas in the sealed portion was carried out, and evaluated by the following three steps.

Good: All of three sealing treatments cause no leak of the helium gas.

Average: one or two of three sealing treatments causes no leak of the helium gas.

Poor: All of three sealing treatments cause leak of the helium gas.

The evaluation results of the anti-corrosive property, processability, and sealing properties are shown in the following Table 1.

TABLE 1

| | Composition of intermediate layer | Average thickness of intermediate layer (μm) | Composition of first film | Average thickness of first film (μm) | Average thickness of second film (nm) | Anti-corrosive property | Process-ability | Sealing properties |
|---|---|---|---|---|---|---|---|---|
| Example 1 | Ni | 1 | Sn | 10 | 3 | Average | Good | Good |
| Example 2 | Ni | 1 | Sn | 10 | 5 | Good | Good | Good |
| Example 3 | Ni | 1 | Sn | 10 | 10 | Very good | Good | Good |
| Example 4 | NI | 1 | Sn | 10 | 100 | Very good | Good | Good |
| Example 5 | Ni | 1 | Sn | 10 | 200 | Very good | Good | Good |
| Example 6 | Ni | 1 | Sn | 10 | 1000 | Average | Average | Average |
| Example 7 | Ni | 1 | Sn | 0.5 | 100 | Average | Good | Good |
| Example 8 | Ni | 1 | Sn | 1 | 100 | Good | Good | Good |
| Example 9 | Ni | 1 | Sn | 5 | 100 | Very good | Good | Good |
| Example 10 | Ni | 1 | Sn | 30 | 100 | Very good | Good | Good |
| Example 11 | Absence | 0 | Sn | 10 | 100 | Very good | Good | Good |
| Example 12 | Zn | 1 | Sn | 10 | 100 | Very good | Good | Good |
| Example 13 | Co | 1 | Sn | 10 | 100 | Very good | Good | Good |
| Example 14 | Cr | 1 | Sn | 10 | 100 | Very good | Good | Good |
| Example 15 | Cu | 1 | Sn | 10 | 100 | Very good | Good | Good |
| Example 16 | Zn, Ni | 1 | Sn | 10 | 100 | Very good | Good | Good |
| Example 17 | Ni | 2 | Sn | 10 | 100 | Very good | Good | Good |
| Example 18 | Ni | 10 | Sn | 10 | 100 | Average | Average | Good |
| Example 19 | Zn, Ni | 2 | Sn | 10 | 100 | Very good | Good | Good |
| Example 20 | Zn, Ni | 10 | Sn | 10 | 100 | Average | Average | Good |
| Example 21 | Ni | 1 | Sn-0.5% by mass Bi alloy | 10 | 5 | Very good | Good | Good |
| Example 22 | Ni | 1 | Sn-3% by mass Bi alloy | 10 | 5 | Very good | Average | Good |
| Example 23 | Ni | 1 | Sn-58% by mass Bi alloy | 10 | 5 | Very good | Average | Good |

TABLE 1-continued

| | Composition of intermediate layer | Average thickness of intermediate layer (μm) | Composition of first film | Average thickness of first film (μm) | Average thickness of second film (nm) | Anti-corrosive property | Process-ability | Sealing properties |
|---|---|---|---|---|---|---|---|---|
| Comparative Example 1 | Ni | 1 | Sn | 10 | Absence | — | Good | Good |
| Comparative Example 2 | Ni | 1 | Sn | Absence | 10 | Poor | Poor | Good |

As shown in the above Table 1, Examples 1 to 23 including the first film and the second film had improved anti-corrosive property without impairing sealing properties as compared with Comparative Example 1 not including the second film, and had improved anti-corrosive property and processability without impairing sealing properties as compared with Comparative Example 2 not including the first film. Therefore, it was found that Examples 1 to 23 having improved anti-corrosive property can exhibit excellent heat transport characteristics even if an object to be cooled having a large amount of heat generation is thermally connected over a long period of time.

By contrasting Examples 2 to 5 with Examples 1 and 6, the average thickness of the second film was 5 to 200 nm, whereby anti-corrosive property, processability, and sealing properties could be improved with a good balance. In Examples 3 to 5, the average thickness of the second film was 10 to 200 nm, whereby more excellent anti-corrosive property could be obtained.

By contrasting Examples 8 to 10 with Example 7, the average thickness of the first film was 1 to 30 whereby more excellent anti-corrosive property could be obtained. In Examples 9 and 10, the average thickness of the first film was 5 to 30 μm, whereby more excellent anti-corrosive property could be obtained.

In Examples 4, and 12 to 16, even if the intermediate layer was formed, and the intermediate layer was made of any of nickel, zinc, cobalt, chromium, and copper, anti-corrosive property, processability, and sealing properties could be improved with a good balance. By contrasting Examples 4, 16, 17, and 19 with Examples 18 and 20, the average thickness of the intermediate layer was 1 to 2 m, anti-corrosive property and processability were further improved.

In Example 2 and Examples 21 to 23, the first film was made of a Sn—Bi alloy, whereby anti-corrosive property could be further improved.

A heat pipe of the present disclosure can prevent the corrosion of a container and the generation of a hydrogen gas caused by a working fluid containing water even if the container is subjected to plastic deformation such as bending or an object to be cooled having a large amount of heat generation is thermally connected to cause an increase in thermal loads, and exhibit excellent heat transport characteristics, whereby the heat pipe can be used in a variety of fields. For example, the heat pipe has a higher use value in the field for cooling an electronic component having a large amount of heat generation.

What is claimed is:

1. A heat pipe comprising a container including a container substrate; and a working fluid enclosed in the container, wherein:

the working fluid contains water;

the heat pipe includes a first film containing tin and/or a tin alloy on at least an inner surface of the container substrate and a second film formed on at least a part of a surface of the first film and containing an oxide and/or hydroxide containing tin;

the container is bent or flattened by plastic deformation with the first film and the second film formed on the inner surface of the container substrate;

the container has a portion sealed by the first film;

a region of the first film where the second film is provided is not exposed to a hollow portion of the container; and both the first film and the second film are laminated together on the portion sealed by the first film of the container.

2. The heat pipe according to claim 1, wherein the first film is a tin alloy containing at least one metal selected from the group consisting of copper, nickel, silver, lead, and bismuth.

3. The heat pipe according to claim 1, wherein an average thickness of the second film is 5 nm or more and 200 nm or less.

4. The heat pipe according to claim 1, wherein the container substrate is made of at least one metal selected from the group consisting of aluminum, an aluminum alloy, magnesium, a magnesium alloy, titanium, a titanium alloy, and stainless steel.

5. The heat pipe according to claim 1, wherein an average thickness of the first film is 1 μm or more and 30 μm or less.

6. The heat pipe according to claim 1, wherein the heat pipe includes one or two or more intermediate layers provided between a surface of the container substrate and the first film and made of at least one metal selected from the group consisting of nickel, zinc, cobalt, chromium, and copper, and/or an alloy containing at least one metal selected from the group consisting of nickel, zinc, cobalt, chromium, and copper.

7. The heat pipe according to claim 6, wherein an average thickness of the intermediate layers is 0.001 μm or more and 2 μm or less.

8. A method for manufacturing a heat pipe comprising a container including a container substrate, and a working fluid containing water enclosed in the container, the method comprising:

a step of preparing a container including a first film containing tin and/or a tin alloy on at least an inner surface of the container substrate and a second film formed on at least a part of a surface of the first film and containing an oxide and/or hydroxide containing tin, wherein the container is bent or flattened by plastic deformation after the first film and second film are formed on the inner surface of the container substrate, wherein the container has a portion sealed by the first film, wherein a region of the first film where the second film is provided is not exposed to a hollow portion of the container; and both the first film and the second film are laminated together on the portion sealed by the first film of the container;

an injecting step of injecting a working fluid into an inside of the container;

a deaerating step of deaerating the inside of the container including the injected working fluid; and a sealing step of sealing an end portion of the deaerated container.

9. The method for manufacturing a heat pipe according to claim 8, further comprising a heat treating step of melting the first film.

* * * * *